US005852974A

United States Patent [19]

Egan et al.

[11] Patent Number: 5,852,974

[45] Date of Patent: Dec. 29, 1998

[54] INTERNAL ADJUSTABLE TENSION FRAME FOR TOUCH-SENSITIVE BOARDS

[75] Inventors: Patrick Egan, Toronto; Jim Long, Bolton; John D. Evans, Toronto, all of Canada

[73] Assignee: Egan Visual Inc., Woodbridge, Canada

[21] Appl. No.: 920,862

[22] Filed: Aug. 29, 1997

[51] Int. Cl.[6] ..... B05C 17/06

[52] U.S. Cl. ..... 101/127.1; 38/102.3

[58] Field of Search ..... 101/114, 127, 101/127.1, 128, 128.1; 160/372, 374, 374.1, 375, 378; 38/102, 102.1, 102.91, 102.3, 102.4

[56] References Cited

U.S. PATENT DOCUMENTS

| | | | |
|---|---|---|---|
| 2,491,600 | 12/1949 | Bearce | 45/130 |
| 3,359,663 | 12/1967 | Black | 38/102.91 |
| 3,507,062 | 4/1970 | Moyer | 38/102.91 |
| 3,828,671 | 8/1974 | Fuchs | 101/123 |
| 3,949,802 | 4/1976 | Buratovich | 160/374.1 |
| 4,041,861 | 8/1977 | Alter | 101/128.4 |
| 4,289,925 | 9/1981 | Lambden | 178/18 |
| 4,800,947 | 1/1989 | Loomis | 160/368.1 |
| 4,922,988 | 5/1990 | Loomis | 160/368.1 |
| 5,220,867 | 6/1993 | Carpenter | 101/127.1 |

*Primary Examiner*—Ren Yan

*Attorney, Agent, or Firm*—Philip Mendes da Costa; Bereskin & Parr

[57] ABSTRACT

A frame assembly comprises a rigid inner frame having a first perimeter; a plurality of independent outer frame members positioned outwardly of the inner frame to define a second perimeter larger than the first perimeter, the second perimeter defining a plane having a front face and a rear face; and a flexible sheet extending across the front face, around the outer frame members and secured in a fixed position on the rear face to define a plurality of longitudinally extending passageways adjacent the second perimeter, the outer frame members positioned in the passageways. A plurality of longitudinally extending members are mounted on at least a portion of the inner frame, each of the longitudinally extending members moveable between a first position and a second position and drivingly connected to the outer frame members whereby movement of a longitudinally extending member between the first and second positions causes at least a portion of one of the outer frame members to move outwardly thereby tensioning at least a portion of the flexible sheet.

15 Claims, 5 Drawing Sheets

INTERNAL ADJUSTABLE TENSION FRAME FOR TOUCH-SENSITIVE BOARDS

FIELD OF THE INVENTION

This invention relates to an internal frame assembly for tensioning a thin flexible sheet, such as the writing surface of a touch-sensitive board.

BACKGROUND OF THE INVENTION

Various types of systems for applying tension to a thin, flexible writing surface or display surface have been developed. These systems are designed to provide sufficient tension to the display or writing surface so that the surface maintains a relatively flat profile.

Lambden (U.S. Pat. No. 4,289,925) discloses a tension system for an electrographic apparatus which includes a transducer pad having a flexible membrane mounted over a base member with facing surfaces of the membrane and base member being electrically conductive and having electrical voltages applied thereto whereby to provide electrical signals representing the co-ordinates of a location at which pressure is applied to the flexible membrane locally by a pen or a stylist. The flexible membrane is attached to and mounted on an outwardly tenshioned rectangular frame member. The frame member may compromise separate frame elements and spring members forcing the elements away from each other. Alternately, the frame member may be resilient and be inwardly compressed during the attachment thereto of the flexible membrane whereby the inherent resilience of the frame member subsequently tensions the flexible membrane.

Carpenter (U.S. Pat. No. 5,220,867) discloses an adjustable tension silk-screen frame. Carpenter discloses an external frame. A pre-tenshioned screen member is glued or otherwise attached to adjustable attachment members. A plurality of screw means are used to adjust the position of the attachment members.

Loomis no. 1 and Loomis no. 2 (U.S. Pat. Nos. 4,800,947 and 4,922,988) disclose a tension mounting system and assembly which may be used with billboards. A flexible sheet which is to be stretched is folded back on itself to create a loop in which a retaining means (such as a longitudinally extending tube) is inserted. The retaining means are positioned in brackets which are affixed to a rigid support surface. Accordingly, the devices of Loomis disclose an assembly wherein the retaining means and the support surface are visible.

Buratovich (U.S. Pat. No. 3,949,802) discloses a device for applying tension to an artist's canvas. The device compromises a substantially right angle bracket member which is adapted to be affixed into a corner of a frame. Adjustment screws are provided for incrementally adjusting the position of members of the frame. A fillet is provided to maintain the frame as perpendicular as the relative position of the frame members is adjusted.

One disadvantage of some of these tensioning systems is that a portion or all of the tensioning assembly is visible from the exterior which distracts from the overall aesthetic appearance of the overall article. A further disadvantage with some of these devices is that the rigid frame defines the exterior surface of the article thereby potentially providing a rough exterior surface.

SUMMARY OF THE INVENTION

In accordance with the instant invention a frame assembly comprises a rigid inner frame having a first perimeter; a plurality of independent outer frame members positioned outwardly of the inner frame members to define a second perimeter larger than the first perimeter, the second perimeter defining a plane having a front face and a rear face; a flexible sheet extending across the front face, around the outer frame members and secured in a fixed position on the rear face to define a plurality of longitudinally extending passageways adjacent the second perimeter, the outer frame members positioned in the passageways; and, a plurality of longitudinally extending members mounted on at least a portion of the inner frame, each of the longitudinally extending members moveable between a first position and a second position and drivingly connected to the outer frame members whereby movement of a longitudinally extending member between the first and second positions causes at least a portion of one of the outer frame members to move outwardly thereby tensioning at least a portion of the flexible sheet.

In a second embodiment, a board is provided having a flexible sheet extending across the front surface of the board and affixed to the rear surface, the flexible sheet defining a series of passageways extending around the perimeter of the board; a plurality of outer frame members positioned in the passageways, each outer frame member independently moveable with respect to adjacent outer frame members; an inner rigid frame having a perimeter less than the perimeter of the board; a plurality of adjustment members, each adjustment member extending between the inner rigid frame and an outer frame member for outward movement of the respective outer frame member.

One advantage of the instant invention is that it provides a frame assembly which is fully encased within a board or the like. The flexible sheet extends across the front of the article, around the outer frame members and is then secured on the rear of the article. Therefore, the front flexible sheet provides an attractive exterior surface for the front, sides and a portion of the rear of the article. If the article is a writing board or the like, then, when the board is in use, the viewers will see an uninterrupted writing surface.

In addition, a further advantage of the instant invention is that it allows incremental adjustment of the tension applied to discreet portions of the outer frame members. Therefore, the writing board may be tenshioned so as to remove any slack which may develop in any portion of the flexible sheet.

DESCRIPTION OF THE DRAWINGS

These and other advantages of the instant invention will be more fully and completely understood in accordance with the description of a preferred embodiment of the invention in which.

DESCRIPTION OF THE PREFERRED EMBODIMENT

Figure 1:
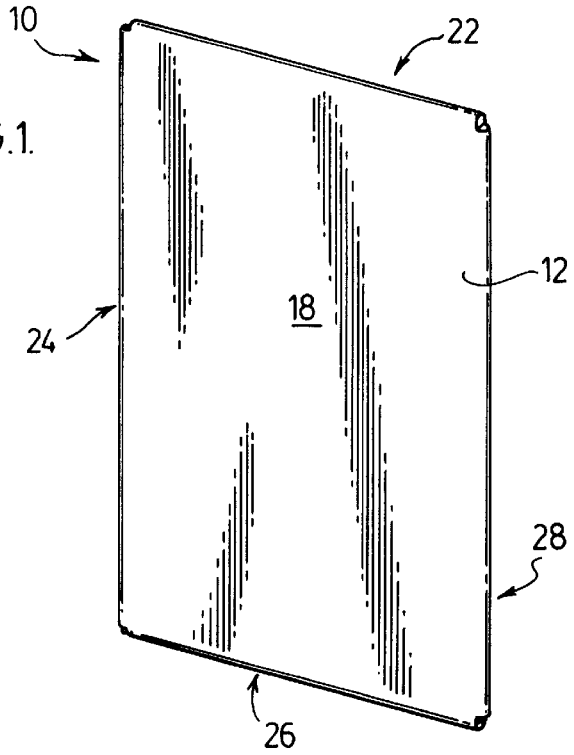
FIG. 1 is a view of the front of a board according to the instant invention.
Figure 3:
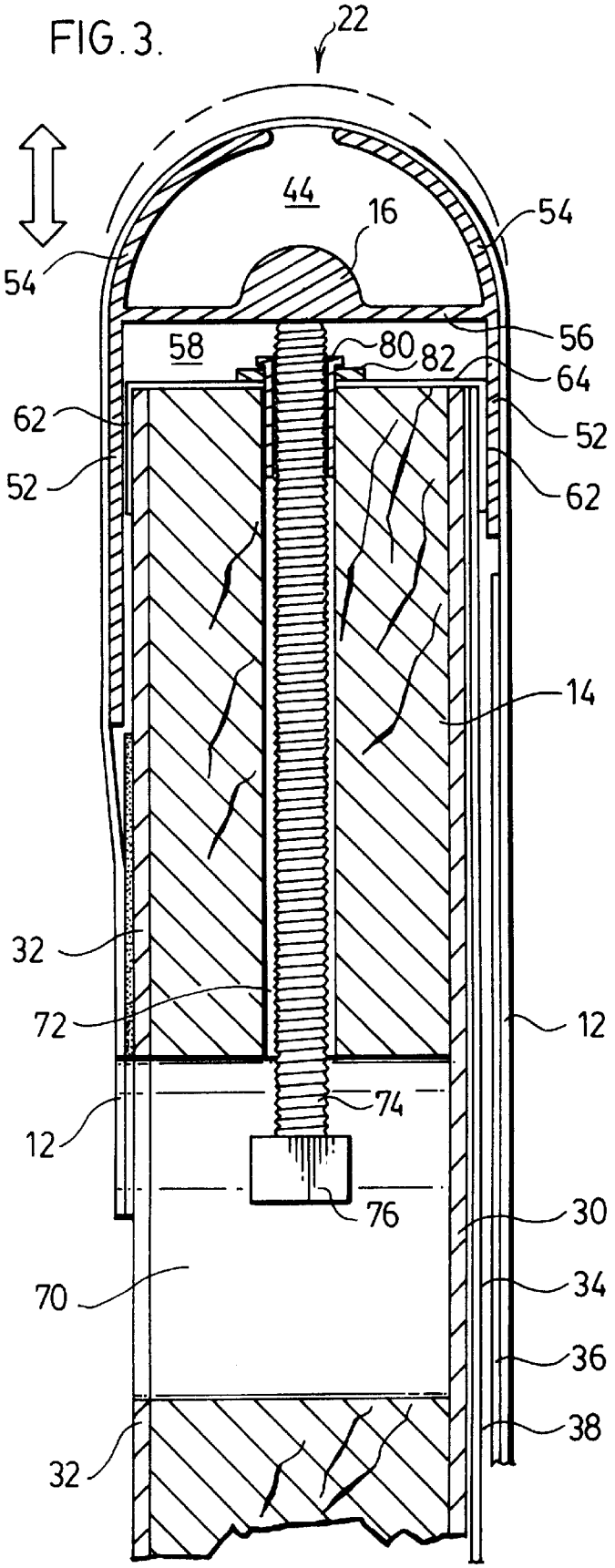
FIG. 3 is a cross-section along the line 3—3 in FIG. 2.
Figure 4:
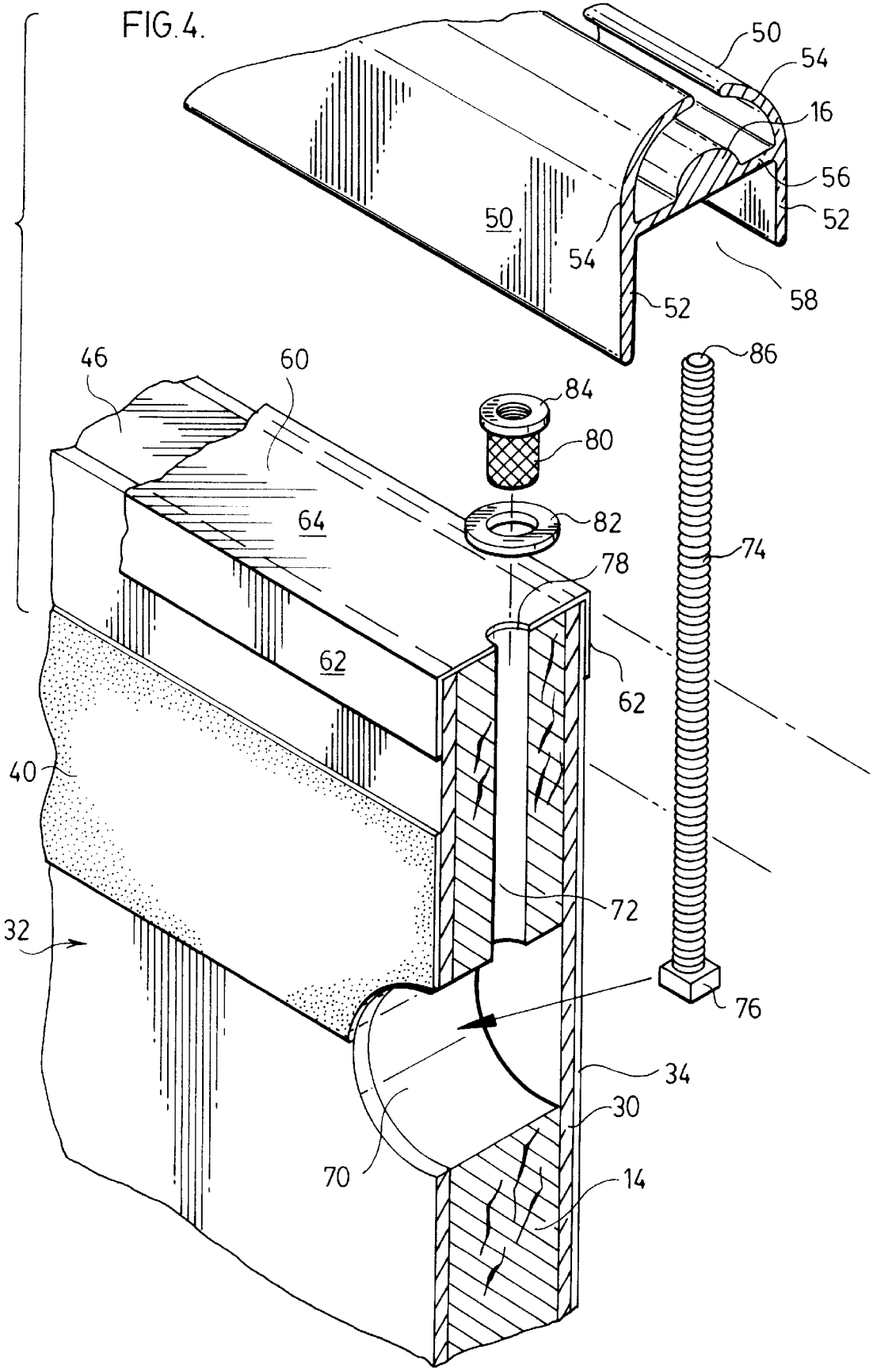
FIG. 4 is a partially exploded view of area A of FIG. 2.
Figure 5:
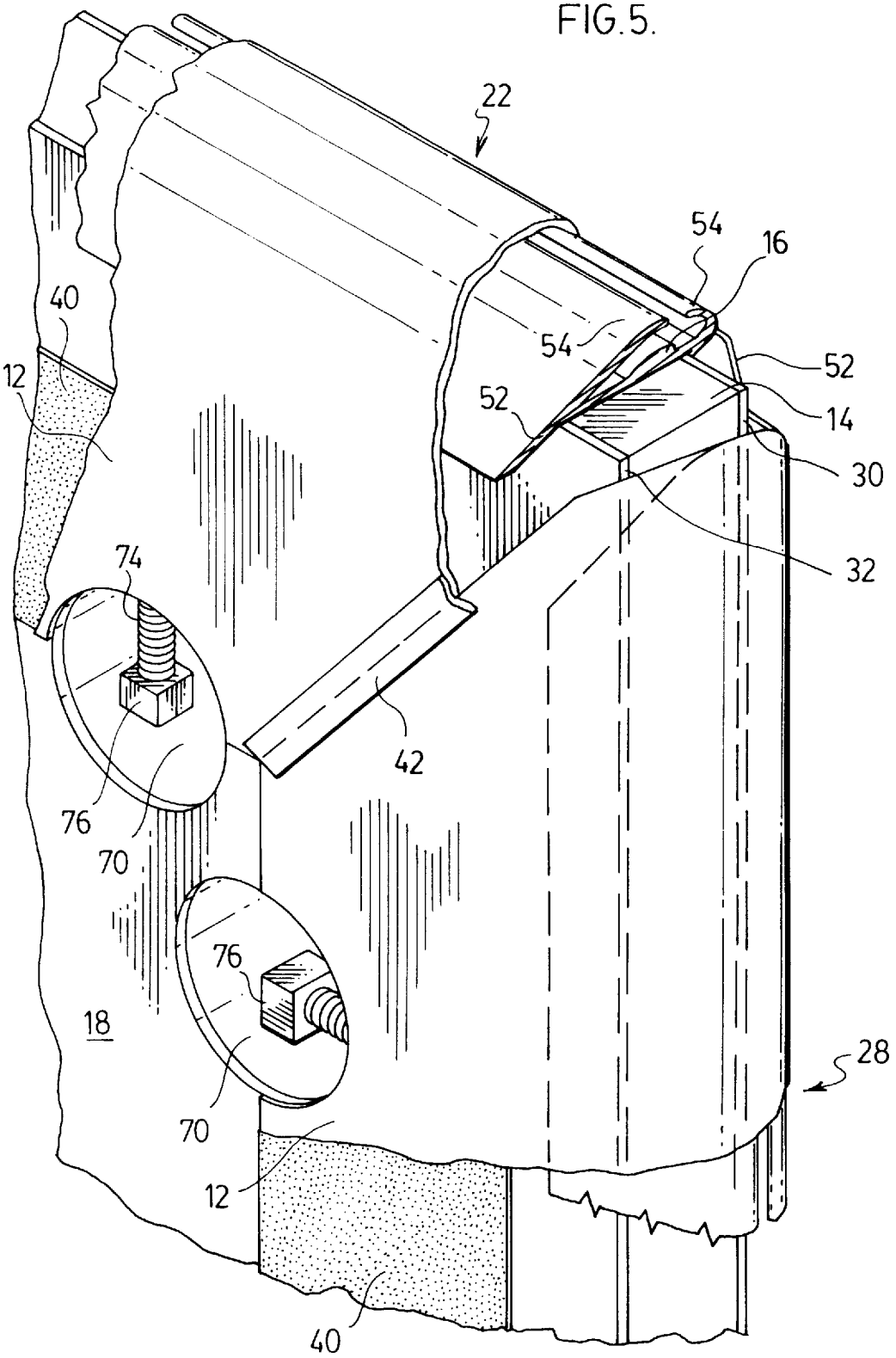
FIG. 5 is a partially cut away view of area A of FIG. 5.

Referring to FIGS. 1, 3 and 4, board 10 or the like has a front flexible sheet 12, inner frame 14 and outer frame members 16. Board 10 has a front surface 18, a rear surface 20 and ends 22, 24, 26 and 28.

The board may be of any particular shape and may be any type of board which has a flexible sheet which is to be tenshioned. Exemplary of such are writing and display boards where the front flexible sheet is not secured throughout its whole extent to an underlying support surface. The internal frame assembly of the instant invention is particularly useful in association with touch-sensitive boards which are known in the art. An example of such a board is shown in FIG. 3.

Referring to FIG. 3, board 10 has a front support member 30 and a rear support member 32. Front and rear support members 30 and 32 are thin planar elements which may be made from a rigid material (e.g. sheet metal). Front and rear support members 30 and 32 are positioned in an opposed fashion with inner frame member 14 extending around the exterior perimeter thereof. Together, inner frame 14 and front and rear support members 30 and 32 define a rigid base for board 10 and define the inner perimeter 46 of board 10.

It will be appreciated that the exact construction of inner frame 14, front support member 30 and rear support member 32 will depend upon the amount of structural support which is required of the board. If front and rear support members 30 and 32 have sufficient structural strength, inner frame 14 may be a plurality of discontinuous members which act as spacers to position rear support member 32 in a fixed position relative to front support member 30. Alternately, one of the support members (e.g. rear support member 32) may not extend all the way across rear surface 20 of board 10. For example, rear support member 32 may comprise a narrow exterior member which extends inwardly from ends 22, 24, 26, and 28 a short distance all the way around the perimeter of board 10 (e.g. co-extensive with inner frame 14). In such a case, inner frame 14 is preferably a continuous rigid frame member which extends around the perimeter of board 10.

In the case of the touch-sensitive screen, a full support member 30 is preferred as is shown in FIG. 3. In particular, an inner conductive layer is positioned adjacent the front face of front support member 30. Outer conductive layer 36 is spaced outwardly from inner conductive layer 34 and is positioned adjacent the inner surface of flexible sheet 12. Preferably, conductive layer 36 is affixed to the inner surface of sheet 12 by any means known in the art, such as by an adhesive. Similarly, inner conductive layer 34 may be affixed to the front surface of front support member 30 by any means known in the art, such as by an adhesive. Provided sufficient tension is provided to flexible sheet 12, gap 38 is maintained between inner and outer conductive layers 34 and 36 over the entire area of front surface 18 of board 10. Electrical currents are passed through conductive layers 34 and 36 as is known in the art. When it is desired to mark a position, pressure is applied to sheet 12 causing outer conductive layer 36 to move into contact with inner conductive layer 34. Typically, a relatively constant and small gap must be maintained between conductive layers 34 and 36 (e.g. about 30 thou). Therefore, it is preferred to be able to adjust incrementally the tension applied to flexible sheet 12 to maintain gap 38. However, the frame assembly of the instant invention may be used in any situation wherein it is desirable to incrementally adjust the tension applied to a flexible sheet.

Figure 2:
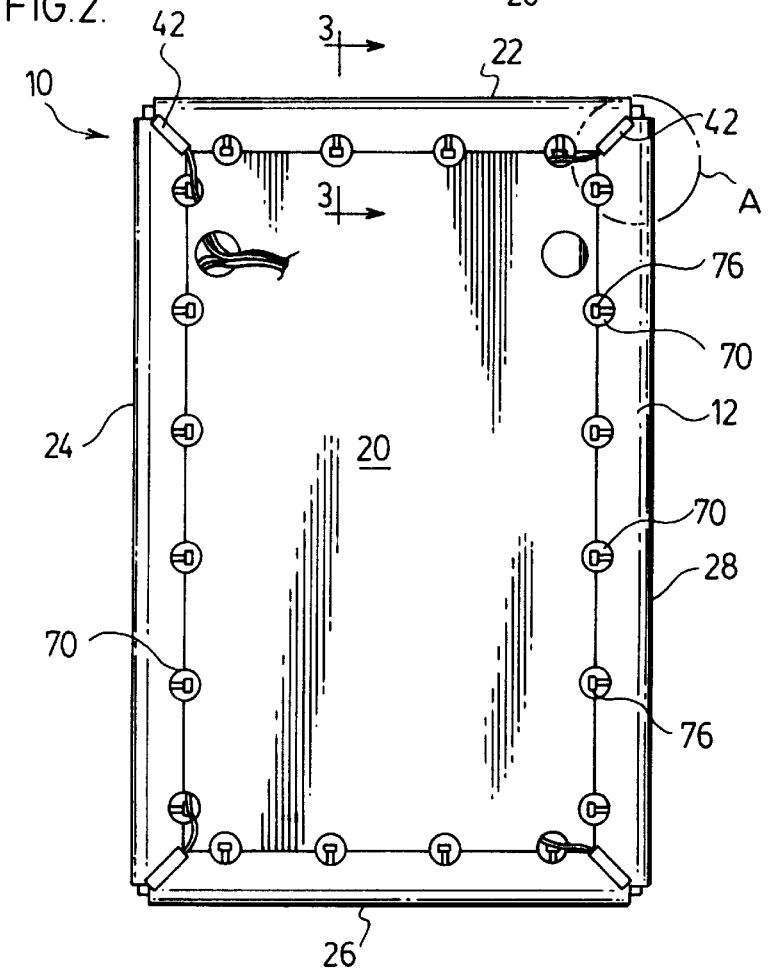
FIG. 2 is a view of the rear of the board of FIG. 1.

Flexible sheet 12 may be made of any material and may have any surface coating applied thereto. In the case of a touch-sensitive screen, flexible sheet 12 may be made of a plastic material and may have a washable or erasable outer surface. Preferably, sheet 12 extends across front surface 18 of board 10, outwardly past the exterior perimeter of inner frame 14 adjacent each ends 22, 24, 26 and 28 and then inwardly onto rear surface 20 of board 10 to define a plurality of longitudinally extending channels 44 (see FIG. 3). As shown in FIG. 2, sheet 12 may extend only part way across rear surface 20. However, it will be appreciated that sheet 12 may extend all the way across rear surface 20 so as to create a clean rear surface. Referring to FIGS. 3 and 4, sheet 12 may be affixed to rear support member 32 by double-sided tape 40. However, any mounting means known in the art may be used. Further, the edges of sheet 12 may be further secured to each other by the use of strips of tape 42 which overlie abutting edges.

Outer frame members 16 are positioned in longitudinally extending passageways 44. Each outer frame member 16 comprises a longitudinally extending member having an outer surface 50. Outer surface 50 may comprise sides 52 and arcuate arms 54 (see FIG. 4). In this embodiment, sides 52 are separated by transverse member 56 so as to add rigidity to outer frame members 16. The inner surfaces of sides 52 and the inner surface of transverse member 58 define a U-shaped channel in which is received the perimeter portion of inner frame member 14. It will be appreciated that the outer portion of outer frame member 16 may be of any particular design. As shown in the preferred embodiment, a pair of arcuate arms 54 are used to define a rounded exterior surface. This particular design is considered advantageous in providing a smooth continuous surface over which flexible sheet 12 may extend. Thus, there are no sharp corners which may create stress points at which sheet 12 may rip. However, it will be appreciated by those skilled in the art that various profiles for outer frame member 16 may be provided. It will further be apparent to those skilled in the art that a single outer frame member 16 may extend along, or substantially along, each end 22, 24, 26 and 28. Alternately, a plurality of discrete outer frame member 16 may extend along each end 22, 24, 26 and 28.

Each outer frame member 16 is positioned for independent motion relative to each adjacent outer frame member 16. Accordingly, for example, if a single outer frame member extends along the length of each end 22, 24 and 26, then outer frame member 16 in passageway 44 of end 24 would be mounted for movement independent of the outer frame members 16 in passageways 44 of ends 22 and 26. In the preferred embodiment, each outer frame member 16 extends along substantially the entire length of the respective end that it overlies and is not connected to adjacent frame members. However, it will be appreciated that outer frame members 16 may be connected to each other provided means is provided to allow the relative outward movement of each outer frame member 16.

End cap 60 extends around, or substantially around, the outer edges of support members 30 and 32 along inner perimeter 46. End cap 60 comprises sides 62 and top plate 64 to define a U-shaped channel. Inner and outer support members 30 and 32 and inner frame member 14 are received within the U-shaped channel. U-shaped channel 58 of outer frame member 16 is sized so as to receive therein end cap 60. U-shaped channel 58 is preferably slightly wider than end cap 60 so that it may slide thereover without frictional engagement. Thus, outer frame member 16 may slide inwardly or outwardly with respect to inner perimeter 46 due to tensional forces which are applied to it without interference from any frictional engagement with end cap 60.

A plurality of openings 70 are provided in inner frame 14. Further, if rear support member 32 extends sufficiently interior of the perimeter of board 10, then openings 70 also extend through rear support member 32. Extending outwardly through inner frame member 14 from an internal position of each opening 70 is a bore 72. Bore 72 is sized so as to receive therein a threaded bolt 74 having a head 76 and a distal end 86. If end cap 64 extends across or substantially along inner perimeter 46, then an opening 78 is provided in top plate 64 where it overlies bore 72.

End cap 64 is preferably provided so as to provide a rigid member to absorb stress from the tension which is applied by bolt 74 to outer frame member 76. In order to secure bolt 74 in bore 72 and transmit these stresses to end plate 64, threaded member 80 and washer 82 are preferably provided. Threaded member 80 comprises a cylindrical member which is sized to be received in bore 72. Threaded member 80 has an internal threaded surface which is sized so as to engageably receive the threads of bolt 74. Threaded member 80 has an annular top 84. Washer 82 is positioned when installed between plate 64 and annular top 84 of threaded member 80. Bolt 74 is of a sufficient length to extend from opening 70 through bore 72, washer 82 and threaded member 80 to engage the lower surface of transverse member 56 of outer frame member 16.

Head 76 of bolt 74 is accessible from the rear of board 10 through openings 70. Accordingly, by using a spanner or the like which engages head 76, a user may rotate bolt 74. Rotation of bolt 74 will cause either inward or outward travel of distal end 86 of bolt 74, depending upon the direction in which head 76 is turned. Accordingly, by turning head 76 in a first direction, bolt 74 will move outwardly pushing outer frame member 16 outwardly in the direction of the arrow shown in FIG. 3.

Figure 6:
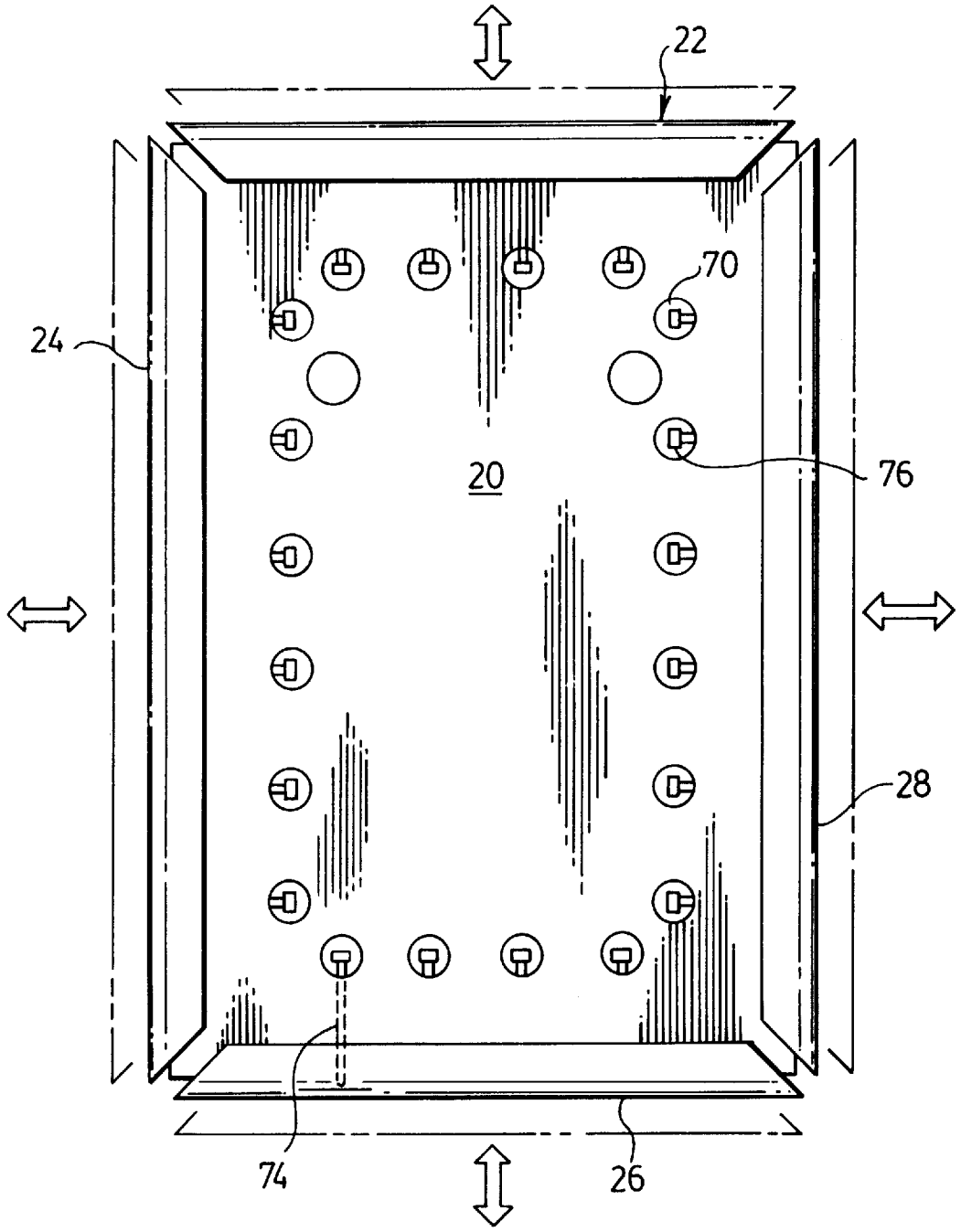
FIG. 6 is a rear view of the board of FIG. 6 showing the possible outward movement of the outer frame members.

Referring to FIG. 6, it will be appreciated that a plurality of bolts 74 may be provided. Adjustment of each bolt 74 will cause a portion of outer frame member 16 to move outwardly or inwardly as shown by the arrows in FIG. 6. Accordingly, if during the life of a board 10, some slack develops in flexible sheet 12, the user may rotate the appropriately positioned bolts 74 so as to apply the requisite additional amount of outward movement of outer frame member 16 so as to adsorb the slack and tension flexible sheet 12 to the desired tension. It will further be appreciated that by rotating bolt 74 in the reverse direction, tension may be relieved. This is beneficial in case too much tension has been applied to flexible sheet 12.

It will be appreciated that bolts 74 may be provided adjacent only two of the ends of board 10 (e.g. ends 22 and 24). Further, additional or fewer bolts may be provided. One advantage of the instant invention is that each bolt may be independently accessed and adjusted so as to ensure that the correct amount of tension is provided across the entire surface area of flexible sheet 12. It will further be appreciated that other constructions may be utilized for mounting bolt 74 in board 72. For example, bore 72 of inner frame 14 may be threaded. Further, if inner frame member were constructed of, e.g., metal, then threaded member 80 and bolt 82 may not be required. However, in the preferred embodiment, frame member 14 is constructed of wood and accordingly metal reinforcing members, eg. end cap 60, threaded member 80 and washer 82 are provided to provide a fixed threaded member for receiving bolt 74.

We claim:

1. A frame assembly comprising:

(a) a rigid inner frame having a first perimeter;

(b) a plurality of independent outer frame members positioned outwardly of the inner frame to define a second perimeter larger than the first perimeter, the second perimeter defining a plane having a front face and a rear face;

(c) a flexible sheet extending across the front face, around the outer frame members and secured in a fixed position on the rear face to define a plurality of longitudinally extending passageways adjacent the second perimeter, the outer frame members positioned in the passageways; and, (d) a plurality of longitudinally extending members mounted on at least a portion of the inner frame, each of the longitudinally extending members moveable between a first position and a second position and drivingly connected to the outer frame members whereby movement of a longitudinally extending member between the first and second positions causes at least a portion of one of the outer frame members to move outwardly thereby tensioning at least a portion of the flexible sheet.

2. The frame assembly as claimed in claim 1 wherein the longitudinally extending members are accessible from the rear for actuation of the movement of the longitudinally extending members.

3. The frame assembly as claimed in claim 2 wherein the longitudinally extending members are threaded members and rotation of the threaded members in a first direction causes outward movement of at least a portion of one of the outer frame members.

4. The frame assembly as claimed in claim 3 wherein each longitudinally extending member has an inner end and an outer end, the inner end comprising a head which is accessible from the rear for independent rotation of the longitudinally extending member.

5. The frame assembly as claimed in claim 4 wherein the rear face has a plurality of openings, one of the heads being accessible from each of the openings.

6. The frame assembly as claimed in claim 1 wherein each of the longitudinally extending members comprises a threaded member having an inner end and an outer end, the inner end comprising a head, each longitudinally extending member extending through an opening in the inner frame.

7. The frame assembly as claimed in claim 6 wherein each outer frame member has an inner surface for receiving the outer end of the threaded member.

8. The frame assembly as claimed in claim 6 wherein the inner surface of the outer frame member defines a channel and the outer end of the threaded member is in an abutting relationship therewith.

9. A board having a front surface, a rear surface and an outer perimeter comprising:

(a) a flexible sheet extending across the front surface of the board and affixed to the rear surface, the flexible sheet defining a series of passageways extending around the perimeter of the board;

(b) a plurality of outer frame members positioned in the passageways, each outer frame member independently moveable with respect to adjacent outer frame members;

(c) an inner rigid frame having a perimeter less than the perimeter of the board;

(d) a plurality of adjustment members, each adjustment member extending between the inner rigid frame and an outer frame member for outward movement of the respective outer frame member, each adjustment member comprising a threaded member having an inner end and an outer end, the inner end comprising a head, each adjustment member extending through an opening in the inner frame.

10. The board as claimed in claim 9 wherein the adjustment members are accessible from the rear for adjustment of the adjustment members.

11. The board as claimed in claim 10 wherein the adjustment members are threaded members and rotation of the threaded members in a first direction causes outward movement of at least a portion of one of the outer frame members.

12. The board as claimed in claim 11 wherein each adjustment member has an inner end and an outer end, the inner end comprising a head which is accessible from the rear for independent rotation of the adjustment member.

13. The board as claimed in claim 12 wherein the rear surface has a plurality of openings, one of the heads being accessible from each of the openings.

14. The board as claimed in claim 9 wherein each outer frame member has an inner surface for receiving the outer end of the threaded member.

15. The board as claimed in claim 9 wherein the inner surface of the outer frame member defines a channel and the outer end of the threaded member is in an abutting relationship therewith.

* * * * *